US009657430B2

(12) United States Patent
Lee et al.

(10) Patent No.: US 9,657,430 B2
(45) Date of Patent: May 23, 2017

(54) CONDENSING TYPE CLOTHES DRYER HAVING A HEAT PUMP CYCLE AND A METHOD FOR CONTROLLING A CONDENSING TYPE CLOTHES DRYER HAVING A HEAT PUMP CYCLE

(71) Applicant: LG ELECTRONICS INC., Seoul (KR)

(72) Inventors: Yongju Lee, Seoul (KR); Byeongjo Ryoo, Seoul (KR); Jongseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/960,549

(22) Filed: Dec. 7, 2015

(65) Prior Publication Data

US 2016/0160428 A1 Jun. 9, 2016

(30) Foreign Application Priority Data

Dec. 8, 2014 (KR) ..... 10-2014-0175158

(51) Int. Cl.
*D06F 58/28* (2006.01)
*D06F 58/20* (2006.01)

(52) U.S. Cl.
CPC ..... *D06F 58/206* (2013.01); *D06F 58/28* (2013.01); *D06F 2058/287* (2013.01)

(58) Field of Classification Search
CPC ..... F26B 19/00; F26B 21/00; D06F 58/00; D06F 58/28; D06F 58/206; D06F 2058/287

(Continued)

(56) References Cited

U.S. PATENT DOCUMENTS 7,020,985 B2 * 4/2006 Casey ..... D06F 58/206 34/595
7,191,543 B2 * 3/2007 Yakumaru ..... D06F 58/206 34/77

(Continued)

FOREIGN PATENT DOCUMENTS

DE 102 55 575 C1 12/2003
DE 10 2011 078 922 1/2013

(Continued)

OTHER PUBLICATIONS

European Search Report dated Apr. 15, 2016.
Korean Office Action dated Jul. 9, 2014.

*Primary Examiner* — Stephen M Gravini
(74) *Attorney, Agent, or Firm* — Ked & Associates LLP

(57) ABSTRACT

A condensing type clothes dryer having a heat pump cycle is provided that may include a drum in which an object to be dried may be accommodated; a circulation duct that forms a circulation passage such that air may circulate via the drum; and a heat pump cycle. The heat pump cycle may include a plurality of evaporators provided adjacent to each other in the circulation duct; a condenser provided at a downstream side of the plurality of evaporators and spaced therefrom, that absorbs heat of air discharged from the drum through the plurality of evaporators, and transfers the heat to air introduced into the drum through the condenser, using an operation fluid, which may circulate via the plurality of evaporators and the condenser; a plurality of divergence pipes that form a divergence passage, such that the operation fluid discharged from the condenser may be introduced into each of the plurality of evaporators; a plurality of electronic expansion valves provided at the plurality of divergence pipes, respectively, that opens and closes the plurality of divergence passage; and a controller that controls a flow amount of the operation fluid to be introduced into each of (Continued)

the plurality of evaporators by controlling an open degree of the divergence passage based on a super heat degree of the operation fluid passing through each of the plurality of evaporators.

20 Claims, 4 Drawing Sheets

(58) Field of Classification Search
USPC ..... 34/427, 497, 601; 68/19, 20; 8/149, 159
See application file for complete search history.

(56) References Cited

U.S. PATENT DOCUMENTS 7,409,776 B2 * 8/2008 Ono ..... D06F 58/206 34/606
7,908,766 B2 * 3/2011 Ahn ..... D06F 58/206 126/21 A
8,266,824 B2 * 9/2012 Steiner ..... D06F 58/206 34/595
8,533,975 B2 * 9/2013 Beers ..... D06F 58/206 165/11.1
8,601,717 B2 * 12/2013 Beers ..... D06F 58/206 137/597
9,146,056 B2 * 9/2015 Lee ..... F26B 21/086
9,163,352 B2 * 10/2015 Han ..... D06F 58/26
9,238,886 B2 * 1/2016 Ryoo ..... D06F 58/02
9,273,903 B2 * 3/2016 Vian ..... D06F 58/24
9,285,166 B2 * 3/2016 Tezcan ..... D06F 58/206
9,534,329 B2 * 1/2017 Contarini ..... D06F 29/005
2007/0107255 A1 5/2007 Tamura et al.
2016/0160427 A1 * 6/2016 Lee ..... D06F 58/206 34/443
2016/0160428 A1 * 6/2016 Lee ..... D06F 58/206 34/427
2016/0186374 A1 * 6/2016 Ryoo ..... D06D 58/206 34/86
2016/0298280 A1 * 10/2016 Schaben ..... D06F 58/20

FOREIGN PATENT DOCUMENTS

EP 0 732 551 9/1996
JP 2008-29654 2/2008
JP 2008-142101 6/2008
JP 2014-54377 3/2014
KR 10-2011-0082240 7/2011
KR WO 2012020943 A2 * 2/2012 ..... D06F 58/02
KR 10-2013-0101914 9/2013
KR EP 3031974 A1 * 6/2016 ..... D06F 58/206
KR EP 3031975 A1 * 6/2016 ..... D06F 58/206
KR EP 2550390 B1 * 10/2016 ..... D06F 58/02

* cited by examiner

CONDENSING TYPE CLOTHES DRYER HAVING A HEAT PUMP CYCLE AND A METHOD FOR CONTROLLING A CONDENSING TYPE CLOTHES DRYER HAVING A HEAT PUMP CYCLE

CROSS-REFERENCE TO RELATED APPLICATION(S)

Pursuant to 35 U.S.C. §119(a), this application claims priority to Korean Application No. 10-2014-0175158, filed in Korea on Dec. 8, 2014, the contents of which is incorporated by reference herein in its entirety.

BACKGROUND

1. Field

A condensing type clothes dryer having a heat pump cycle, and a method for controlling a condensing type clothes dryer having a heat pump cycle are disclosed herein.

2. Background

Generally, a clothes dryer is an apparatus for drying laundry by evaporating moisture contained in the laundry, by blowing a hot blast generated by a heater into a drum. The clothes dryer may be classified into an exhausting type clothes dryer and a condensing type clothes dryer according to a processing method of humid air having passed through a drum after drying laundry.

In the exhausting type clothes dryer, humid air having passed through a drum is exhausted outside of the clothes dryer. On the other hand, in the condensing type clothes dryer, humid air having passed through a drum is circulated without being exhausted outside of the clothes dryer. Then, the humid air is cooled to a temperature less than a dew-point temperature by a condenser, so moisture included in the humid air is condensed.

In the condensing type clothes dryer, condensate water condensed by a condenser is heated by a heater, and then heated air is introduced into a drum. While humid air is cooled to be condensed, thermal energy of air is lost. In order to heat the air to a temperature high enough to dry laundry, an additional heater is required.

In the exhausting type clothes dryer, air of high temperature and high humidity should be exhausted outside of the clothes dryer, and external air of room temperature should be introduced to be heated to a required temperature by a heater. As drying processes are executed, air discharged from an outlet of the drum has low humidity. The air is not used to dry laundry, but rather, is exhausted outside of the clothes dryer. As a result, a heat quantity of the air is lost. This may degrade thermal efficiency.

Recently, a clothes dryer having a heat pump cycle, capable of enhancing energy efficiency by collecting energy discharged from a drum and by heating air introduced into the drum using the energy, has been developed.

FIG. 1 is a schematic view illustrating an example of a condensing type clothes dryer having a heat pump cycle. Referring to FIG. 1, the condensing type clothes dryer may include a drum 1 into which laundry may be introduced, a circulation duct 2 that provides a passage such that air circulates via the drum 1, a circulation fan 3 configured to move circulating air along the circulation duct 2, and a heat pump cycle 4 having an evaporator 5 and a condenser 6 serially installed along the circulation duct 2, such that air circulating along the circulation duct 2 passes through the evaporator 5 and the condenser 6. The heat pump cycle 4 may include a circulation pipe, which forms the circulation passage, such that a refrigerant circulates via the evaporator 5 and the condenser 6, and a compressor 7 and an expansion valve 8 installed along the circulation pipe between the evaporator 5 and the condenser 6.

In the heat pump cycle 4, thermal energy of air having passed through the drum 1 may be transferred to a refrigerant via the evaporator 5, and then the thermal energy of the refrigerant may be transferred to air introduced into the drum 1 via the condenser 6. With such a configuration, a hot blast may be generated using thermal energy discarded by the conventional exhausting type clothes dryer or lost in the conventional condensing type clothes dryer.

In the condensing type clothes dryer having a heat pump cycle, in order to increase a heat exchange amount between air and a refrigerant in a heat exchanger, such as an evaporator or a condenser, all components should have a large size. For example, a compressor, the heat exchanger should have a large size, and the amount of refrigerant to be injected should be increased.

In the condensing type clothes dryer having a heat pump cycle, a fin and tube-type heat exchanger is generally used. In a case of the fin and tube-type heat exchanger, a heat exchange amount between air and a refrigerant may be increased as a refrigerant pipe may be divided, and a length of the refrigerant pipe may be extended. However, while the refrigerant pipe may be divided and the length of the refrigerant pipe extended, a pressure loss may occur.

The following formula 1 (Darcy-Weisbach Equation) denotes a pressure loss formula based on friction between the refrigerant pipe and a refrigerant:

$$\Delta P = f\frac{L}{D}\frac{v^2}{2g} \qquad \text{(Formula 1)}$$

where P: Pressure (kgf/cm2), L: Length of pipe (m), f: Friction coefficient, D: Inner diameter of pipe (m), v: Velocity of fluid (m/s), g: Acceleration of gravity (m/s2)

According to formula 1, a pressure loss ($\Delta P$) is increased when a diameter of a refrigerant pipe of an evaporator is reduced, and a length of the refrigerant pipe is increased.

FIG. 2 is a graph comparing pressure-enthalpy (Ph) of the conventional heat pump cycle (comparative example) with pressure-enthalpy (Ph) of a heat pump cycle according to embodiments disclosed herein. As shown in FIG. 2, in the conventional heat pump cycle, when a refrigerant introduced into an evaporator is evaporated, a reduction in pressure occurs, and thus, a pressure loss occurs. This may cause an increase in power consumption due to an additional load of a compressor.

BRIEF DESCRIPTION OF THE DRAWINGS

Embodiments will be described in detail with reference to the following drawings in which like reference numerals refer to like elements, and wherein.

DETAILED DESCRIPTION

Description will now be given in detail of a condensing type clothes dryer having a heat pump cycle and a method for controlling a condensing type clothes dryer having a heat pump cycle according to embodiments, with reference to the accompanying drawings. For the sake of brief description with reference to the drawings, the same or like components will be provided with the same or like reference numbers, and description thereof will not be repeated. A singular expression in the specification includes a plural meaning unless it is contextually definitely represented.

Embodiments relate to a condensing type clothes dryer capable of reducing pressure loss in an evaporator, and preventing unnecessary power consumption of a compressor, and a method for controlling a condensing type clothes dryer having a heat pump cycle.

Figure 3:
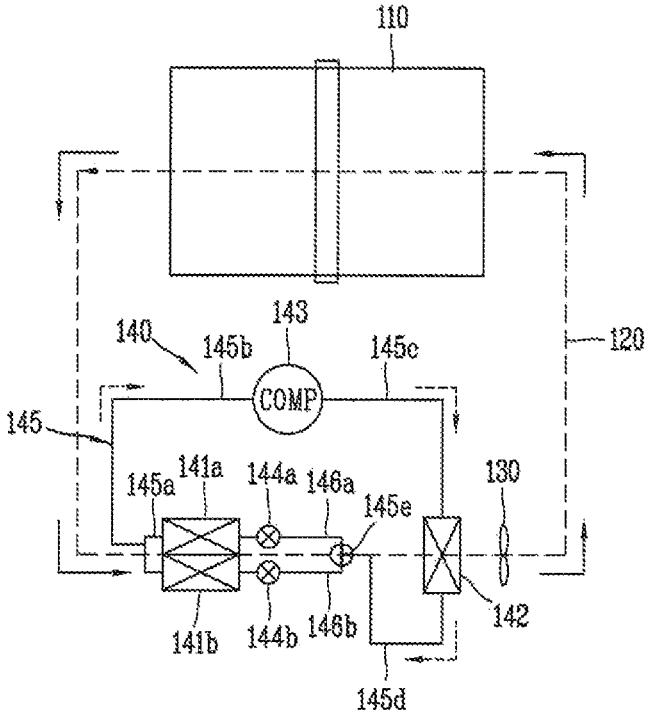
FIG. 3 is a schematic view of a condensing type clothes dryer having a heat pump cycle according to an embodiment.
Figure 4:
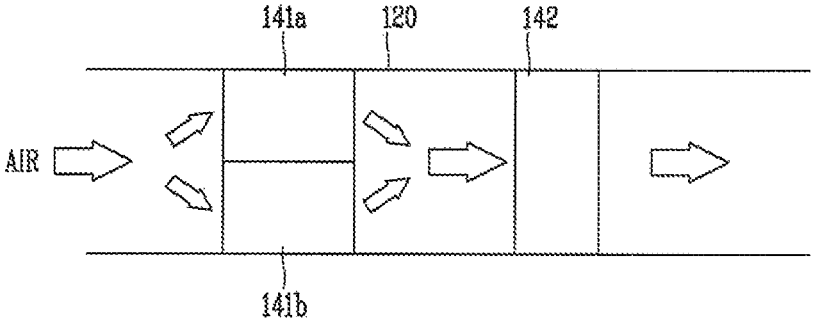
FIG. 4 is a schematic view illustrating a flow of air that passes through an evaporator and a condenser in a circulation duct according to an embodiment.

FIG. 3 is a schematic view of a condensing type clothes dryer having a heat pump cycle according to an embodiment. FIG. 4 is a schematic view illustrating a flow of air that passes through an evaporator and a condenser in a circulation duct according to an embodiment.

The condensing type clothes drier according to embodiments may be an apparatus for drying an object to be dried, such as clothes. The condensing type clothes dryer according to embodiments may include a case, a drum 110 installed in the case and having an accommodation space for an object to be dried, and a heat pump cycle 140 configured to heat air supplied to the drum 110 in order to dry the object to be dried.

The case may form an outer appearance of the condensing type clothes dryer, and may be provided with a circular opening on a front surface thereof, through which an object to be dried may be introduced. A door may be hinge-coupled to one side of the front surface of the case, to open and close the opening.

The case may be provided with a control panel, which may be provided at a front upper end thereof, for facilitation of a user's manipulation. The control panel may be provided with an input through which various functions of the clothes dryer, for example, may be input and a display that displays an operation state of the clothes dryer during a drying function.

The drum 110 may have a cylindrical shape. The drum 110 may be rotatably installed in the case, in a horizontally-laid out state. The drum 110 may be driven using a rotational force of a drive motor as a drive source. A belt (not shown) may be wound on an outer circumferential surface of the drum 110, and a portion of the belt may be connected to an output shaft of the drive motor. With such a configuration, once the drive motor is driven, a drive force may be transmitted to the drum 110 through the belt, thereby rotating the drum 110.

A plurality of lifters may be installed in the drum 110, and an object to be dried, such as wet clothes (laundry) having been completely washed, may be rotated by the plurality of lifters when the drum 110 is rotated. Then, the object to be dried may be dropped in the drum 110 by gravity from a top of a rotational orbit trajectory (tumbling operation). As such processes may be repeatedly performed, the object to be dried may be dried in the drum 110. This may shorten a drying time and enhance drying efficiency.

The condensing type clothes dryer may be provided with a circulation duct 120 to form an air circulating passage in the case and configured to circulate air via the drum 110. Further, the condensing type clothes dryer may be provided with a circulation fan 130 provided at an inner side of the circulation duct 120, and configured to provide a circulation drive force, such that air may flow along the circulation duct 120. The circulation fan 130 may be driven by receiving a drive force from the drive motor.

When the circulation fan 130 is driven, dry air heated by the heat pump cycle 140 may be introduced into the drum 110. Then, the introduced dry air may contact an object to be dried accommodated in the drum 110, thereby drying the object to be dried. The air, which has dried the object to be dried, may be discharged from the drum 110 in a humid state. Then, the discharged humid air may move along the circulation duct 120, thereby being dried and heated by the heat pump cycle 140. Then, the air may be introduced into an inlet of the drum 110 to thus be circulated.

The condensing type clothes dryer may include the heat pump cycle 140 to dry and heat humid air discharged from an outlet of the drum 110. The heat pump cycle 140 may include a plurality of evaporators 141*a*, 141*b*, a compressor 143, a condenser 142, a plurality of electronic expansion valves 144*a*, 144*b*, and a circulation pipe 145.

The circulation pipe 145 may include a convergence pipe 145*a*, first to third pipes 145*b*, 145*c*, 145*d*, and divergence pipes 146*a*, 146*b*, for example. The pipes may connect the plurality of evaporators 141*a*, 141*b*, the compressor 143, the condenser 142, and the plurality of electronic expansion valves 144*a*, 144*b* with each other, and form a circulation path, such that a refrigerant, for example, an operation fluid, may circulate via the plurality of evaporators 141*a*, 141*b*, the compressor 143, the condenser 142 and the plurality of electronic expansion valves 144*a*, 144*b*. The operation fluid may transfer heat.

The plurality of evaporators 141*a*, 141*b* may be provided close to or adjacent to each other in the circulation duct 120. The plurality of evaporators 141*a*, 141*b* may be connected to the outlet of the drum 110 by the circulation duct 120, and humid air discharged from the outlet of the drum 110 may pass through the plurality of evaporators 141*a*, 141*b*. The plurality of evaporators 141*a*, 141*b* may be fin and tube-type heat exchangers.

More specifically, the plurality of evaporators 141*a*, 141*b* may be fin and tube-type heat exchangers including of a plurality of heat exchange fins formed as plates, and a heat transfer pipe having a refrigerant passage. The plurality of heat exchange fins may be spaced from each other in a direction that crosses an air moving direction, and provided so as to extend perpendicular to a ground surface. With such a configuration, air may pass through an air passage formed between the plurality of heat exchange fins when passing through each of the evaporators 141*a*, 141*b*. The heat transfer pipe may have therein a refrigerant passage along which a refrigerant may flow. The heat transfer pipe may be coupled to the plurality of heat exchange fins in a penetrating manner, and portions of the heat transfer pipe may be spaced from each other in a vertical direction. The portions of the heat transfer pipe may be connected to each other by a connection pipe bent in a semi-circular shape. The portions of the heat transfer pipe may increase a contact area with air through the plurality of heat exchange fins, and a refrigerant (operation fluid) flowing in the heat transfer pipes may be heat-exchanged with air passing through the air passage between the heat exchange fins.

Air may pass through the plurality of evaporators 141*a*, 141*b* as follows. Air may be introduced into an inlet of an air passage of each of the plurality of evaporators 141*a*, 141*b*, may move along the air passage, and then may be discharged to an outlet of the air passage of each of the plurality of evaporators 141*a*, 141*b*. A refrigerant may pass through the plurality of evaporators 141*a*, 141*b* as follows. A refrigerant may be introduced into an inlet of a refrigerant passage of each of the plurality of evaporators 141*a*, 141*b*, may move along the refrigerant passage, and then, may be discharged to an outlet of the refrigerant passage of the plurality of evaporators 141*a*, 141*b*. As the air passage between the plurality of heat exchange fins may be separated from the refrigerant passage by the heat transfer pipe, air and a refrigerant may be heat-exchanged with each other without being mixed with each other.

For a reduction in pressure loss in the evaporator, the evaporator may be divided into two evaporators, and a length of a heat transfer pipe of each of the plurality of evaporators 141*a*, 141*b* may be decreased according to a divided number. For example, if the evaporator is divided into two evaporators, a length of the heat transfer pipe of each of the plurality of evaporators 141*a*, 141*b* may be reduced by ½ of a single evaporator. As another example, if the evaporator is divided into three, a length of the heat transfer pipe of each of the plurality of evaporators may be reduced by ⅓ of a single evaporator. As the heat transfer pipe of each of the plurality of evaporators 141*a*, 141*b* is reduced, a pressure loss in the plurality of evaporators 141*a*, 141*b* may be reduced, enhancing performance of the plurality of evaporators 141*a*, 141*b*.

Figure 1:
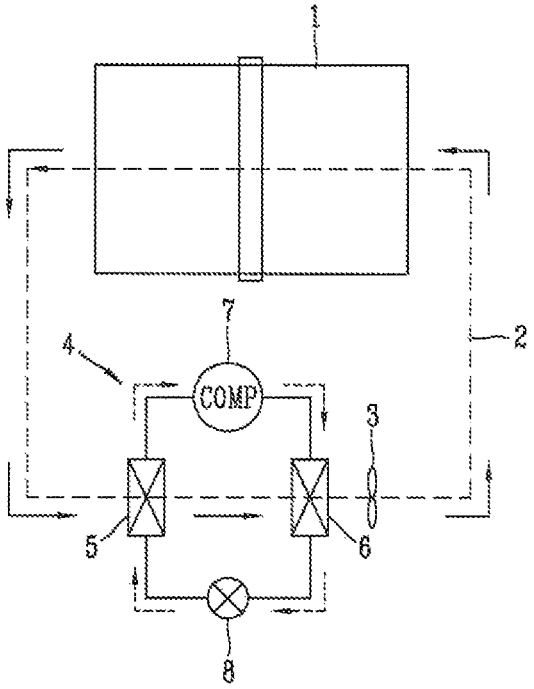
FIG. 1 is a schematic view illustrating an example of a condensing type clothes dryer to which a heat pump cycle is applied.
Figure 2:
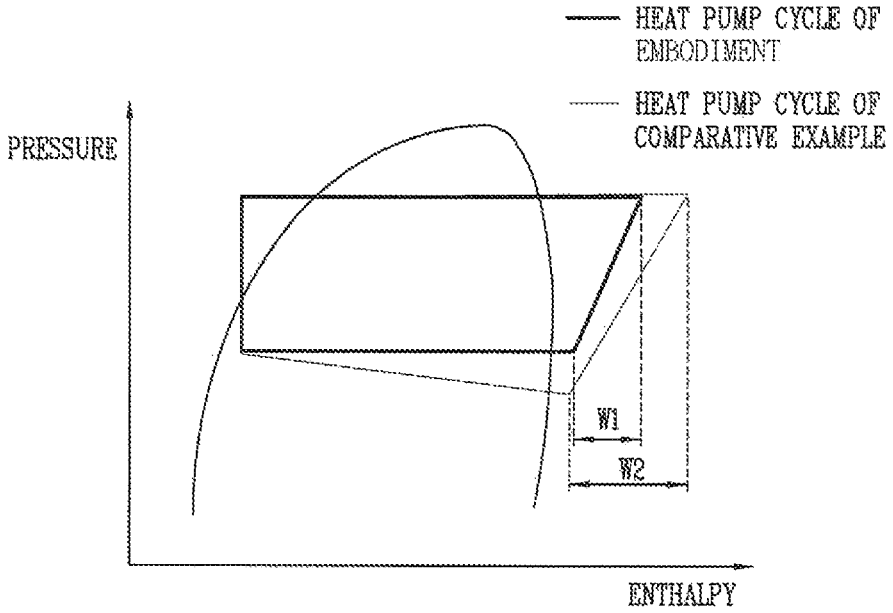
FIG. 2 is a graph comparing pressure-enthalpy (Ph) of a conventional heat pump cycle (comparative example) with pressure-enthalpy (Ph) of a heat pump cycle according to embodiments disclosed herein.

The heat pump cycle 140 according to embodiments will be compared with the heat pump cycle 4 of a comparative example, with reference to the pressure-enthalpy (Ph) graph shown in FIG. 2. In the heat pump cycle 140 according to embodiments, the two evaporators 141*a*, 141*b* are utilized. In contrast, in the heat pump cycle of the comparative example, a single evaporator is utilized.

As shown in FIG. 2, in the heat pump cycle 4 of the comparative example, a refrigerant introduced into the evaporator 5 undergoes pressure lowering while being evaporated, resulting in pressure loss. As a result, a load (W2) of the compressor 7 may be increased. On the other hand, in the heat pump cycle 140 according to embodiments, a refrigerant introduced into each of the evaporators 141*a*, 141*b* may be evaporated without pressure loss. As a result, a load (W1) of the compressor 143 may be decreased. This may enhance performance of the compressor 143.

The plurality of evaporators 141*a*, 141*b* may be provided in the circulation duct 120 in a vertical direction, that is, in a direction substantially perpendicular to a direction of air flow in the circulation duct 120, or sequentially in a line, that is, in a direction of air flow in the circulation duct 120. The plurality of evaporators 141*a*, 141*b* of FIGS. 3 and 4 may include a first evaporator 141*a* and a second evaporator 141*b* provided in the circulation duct 120 in the vertical direction, that is, in the direction substantially perpendicular to the direction of air flow in the circulation duct 120. The first evaporator 141*a* and the second evaporator 141*b* may be laminated on each other in the vertical direction, without any gap therebetween. For a maximized exchange amount between air and a refrigerant in the first and second evaporators 141*a*, 141*b*, an upper portion of the first evaporator 141*a* may be provided close to or adjacent to an upper portion of the circulation duct 120, and a lower portion of the second evaporator 141*b* may be provided close to or adjacent to a lower portion of the circulation duct 120.

As shown in FIG. 4, humid air discharged from the outlet of the drum 110 may be distributed to the first evaporator 141*a* and the second evaporator 141*b* provided in the circulation duct 120 in the vertical direction with a same ratio, thereby simultaneously passing through the first and second evaporators 141*a*, 141*b*. The first evaporator 141*a* and the second evaporator 141*b* may absorb heat from humid air that flows along the air passage between the heat exchange fins, and then, may transfer the heat to a refrigerant that flows along the heat transfer pipe. As heat of air that passes through the first and second evaporators 141*a*, 141*b* may be transferred to a refrigerant that flows along the heat transfer pipes of the first and second evaporators 141*a*, 141*b*, the air having passed through the first evaporator 141*a* and the second evaporator 141*b* may be cooled to be dehumidified.

A refrigerant introduced into the inlet of the refrigerant passage of each of the first evaporator 141*a* and the second evaporator 141*b* may be in a mixed state between a gaseous state and a liquid state, and may absorb heat from air that passes through the first evaporator 141*a* and the second evaporator 141*b*. Thus, the liquid state of the refrigerant may be changed into the gaseous state. The gaseous refrigerant of low temperature and low pressure, evaporated by the first and second evaporators 141*a*, 141*b*, may be transferred to the compressor 143 by the circulation pipe 145. The first and second evaporators 141*a*, 141*b* may be connected to an inlet of a refrigerant passage of the compressor 143, by the convergence pipe 145*a* and the first pipe 145*b*. Refrigerants discharged from the first and second evaporators 141*a*, 141*b* may be mixed with each other by the convergence pipe 145*a*, and then, may be introduced into the compressor 143 by the first pipe 145*b*.

The compressor 143 may serve to compress the gaseous refrigerant of low temperature and low pressure discharged from the first and second evaporators 141*a*, 141*b*, thereby forming high-pressure gas having a higher temperature than air discharged from the drum 110. The refrigerant of high temperature and high pressure may be circulated along the circulation pipe 145 by a circulation drive force generated by the compressor 143.

The compressor 143 may be connected to an inlet of a refrigerant passage of the condenser 142 by the second pipe 145*c* of the circulation pipe 145. With such a configuration, a refrigerant discharged from the compressor 143 may move along the second pipe 145*c*, thereby being transferred to the condenser 142. The gaseous refrigerant of high temperature and high pressure, compressed by the compressor 143, may flow along the heat transfer pipe of the condenser 142, thereby transferring heat to air that passes through the condenser 142.

The condenser 142 may be provided at a downstream side of the first and second evaporators 141*a*, 141*b* in the circulation duct 120, in a spaced manner or spaced therefrom. As the condenser 142 may be connected to the inlet of the drum 110 by the circulation duct 120, air heated by the condenser 142 may be introduced into the drum 110. The condenser 142 may be a fin and tube-type heat exchanger. As the fin and tube-type heat exchanger was discussed above, a detailed explanation thereof has been omitted.

A process by which air is heated by the condenser 142 will be discussed hereinafter. When air passes through the air passage formed between the heat exchange fins of the condenser 142, heat transfer may be performed from a gaseous refrigerant of high temperature and high pressure introduced into the inlet of the heat transfer pipe of the condenser 142, to air that passes through an air passage of the condenser 142. As a result, the air passing through the condenser 142 may be heated.

That is, the gaseous refrigerant of high temperature and high pressure introduced into the inlet of the refrigerant passage of the condenser 142, may be cooled and condensed by air introduced into the air passage of the condenser 142, thereby being changed into a liquid refrigerant of high temperature and high pressure. In this case, condensation latent heat of the refrigerant may be discharged to air passing through the condenser 142, thereby heating the air passing through the condenser 142. The heated air may be discharged from the condenser 142, and may be introduced into the inlet of the drum 110 by the circulation fan 130 to circulate.

Figure 7:
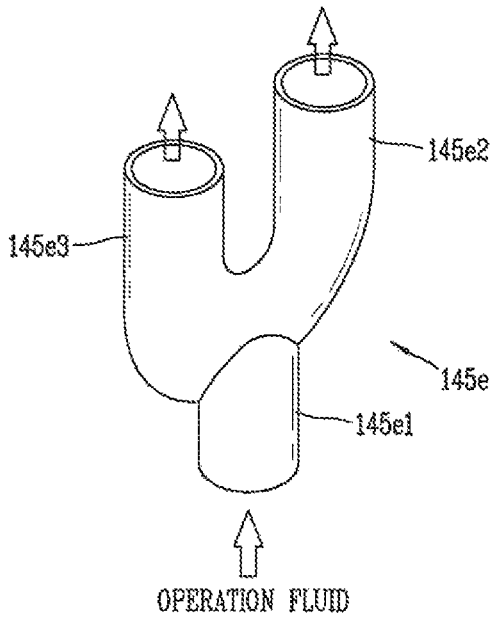
FIG. 7 is a perspective view illustrating a divergence pipe according to an embodiment.

FIG. 7 is a perspective view illustrating a divergence pipe according an embodiment. The liquid refrigerant of high temperature and high pressure, discharged from the condenser 142, may be transferred to the plurality of electronic expansion valves 144*a*, 144*b* by the circulation pipe 145. An outlet of the refrigerant passage of the condenser 142 may be connected to the first and second evaporators 141*a*, 141*b* by the third pipe 145*d* and the plurality of divergence pipes 146*a*, 146*b*. The third pipe 145*d* may be connected to the plurality of divergence pipes 146*a*, 146*b* by the divergence pipe 145*e*. For example, the divergence pipe 145*e* of FIG. 7 may be provided with a single inlet 145*e*1 at a first side, and two outlets 145*e*2 diverged from the inlet 145*e*1 at a second side. The inlet 145*e*1 of the divergence pipe 145*e* may be connected to the third pipe 145*d*, and the outlets 145*e*2 of the divergence pipe 145*e* may be connected to the plurality of divergence pipes 146*a*, 146*b*. The plurality of divergence pipes 146*a*, 146*b* may form a divergence passage, such that a refrigerant discharged from the condenser 142 may be introduced into each of the first and second evaporators 141*a*, 141*b*. A refrigerant discharged from the condenser 142 may be diverged by the third pipe 145*d*, the divergence pipe 145*e* and the plurality of divergence pipes 146*a*, 146*b*, thereby moving along the plurality of divergence pipes 146*a*, 146*b*. Then, the refrigerant may be introduced into each of the first evaporator 141*a* and the second evaporator 141*b*.

The plurality of electronic expansion valves 144*a*, 144*b* may be provided at the plurality of divergence pipes 146*a*, 146*b*, respectively, thereby opening and closing the divergence passage. The plurality of electronic expansion valves 144*a*, 144*b* may serve to lower pressure and temperature of a refrigerant, such that a heat absorbing operation by evaporation of a refrigerant liquid may be facilitated. Also, the plurality of electronic expansion valves 144*a*, 146*b* may serve to control a flow amount of a refrigerant in correspondence to change in an evaporation load. The plurality of electronic expansion valves 144*a*, 144*b* may be controlled by a control signal of a controller 153.

The plurality of electronic expansion valves 144*a*, 144*b* may be provided therein with a narrow passage, such as an orifice, and their pressure may be decreased without exchanging thermal energy with the outside when a liquid refrigerant passes through the narrow passage. More specifically, as a refrigerant passes through the narrow passage, pressure loss may occur due to friction of the fluid and increase of an eddy current. As a result, pressure of the plurality of electronic expansion valves 144*a*, 144*b* may be reduced. Further, if pressure of a liquid refrigerant becomes lower than a saturated pressure, a portion of the liquid refrigerant may be evaporated. Then, the liquid refrigerant may absorb heat required for evaporation, from itself. As a result, a temperature of the liquid refrigerant may be decreased.

The liquid refrigerant of high pressure and high temperature, discharged from the condenser 142, may be reduced in pressure by the plurality of electronic expansion valves 144*a*, 144*b*, drastically lowering its temperature. As a result, the refrigerant may be converted into a saturated refrigerant of lower temperature and low pressure. Then, the refrigerant of low temperature may be introduced into each of the first and second evaporators 141*a*, 141*b*, thereby absorbing heat from air in the circulation duct 120.

Figure 8:
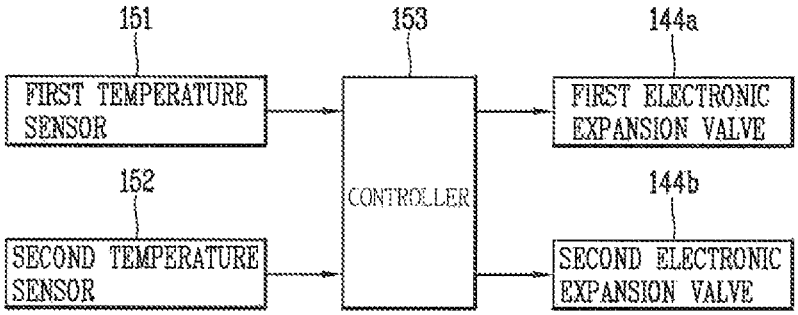
FIG. 8 is a block diagram of an apparatus for controlling a flow amount of a refrigerant introduced into an evaporator according to an embodiment.

FIG. 8 is a block diagram of an apparatus for controlling a flow amount of a refrigerant introduced into an evaporator according to an embodiment. The condensing type clothes dryer according to an embodiment may include the controller 153 that controls a flow amount of a refrigerant introduced into each of the first and second evaporators 141*a*, 141*b* by controlling an open degree of a divergence passage, based on a super heat degree of the refrigerant (operation fluid) passing through each of the first and second evaporators 141*a*, 141*b*. A flow amount of a refrigerant to be introduced into each of the first evaporator 141*a* and the second evaporator 141*b* shown in FIGS. 3 and 4 may be controlled by the first and second expansion valves 144*a*, 144*b* provided at the divergence pipes 146*a*, 146*b*.

An inside of the first and second evaporators 141*a*, 141*b* may have a saturated refrigerant of low pressure in which a liquid refrigerant may be mixed with a gaseous state refrigerant. For example, more than about 90% of a refrigerant immediately having passed through the plurality of electronic expansion valves 144*a*, 144*b* may be a liquid refrigerant, and it may be converted into a gaseous refrigerant while being evaporated through the first and second evaporators 141*a*, 141*b* by absorbing heat from air discharged from the drum 110. Theoretically, a refrigerant at the outlet of the first and second evaporators 141*a*, 141*b* and the inlet of the compressor 143 should have a completely gaseous state, so as to be smoothly compressed by the compressor 143.

If air discharged from the drum 110 has a great load change, a refrigerant having passed through the first and second evaporators 141*a*, 141*b* may be in a liquid state. Once the liquid refrigerant is introduced into the compressor 143, the compressor 143 may be damaged. To prevent this, a refrigerant may be heated to have a temperature increase of about 5° C. such that the refrigerant may be prevented from being in a liquid state, while being introduced into the compressor 143 via the inlet of each of the first and second evaporators 141*a*, 141*b*. This process is called 'super heating (overheating) of a refrigerant'. According to an embodiment, a super heat degree of a refrigerant may be defined as a difference between an inlet temperature of the first and second evaporators 141*a*, 141*b* and an inlet temperature of the compressor 143.

In order to measure a super heat degree of a refrigerant, a first temperature sensor 151 may be installed at the inlet of the refrigerant passage of each of the first and second evaporators 141*a*, 141*b*, thereby measuring an inlet temperature of each of the first and second evaporators 141*a*, 141*b*. A second temperature sensor 152 may be installed at the inlet of the compressor 143, thereby measuring an inlet temperature of the compressor 143. The controller 153 may receive detection signals from the first and second temperature sensors 151, 152, thereby calculating a super heat degree of a refrigerant based on a temperature difference between the inlet temperature of each of the first and second evaporators 141*a*, 141*b* and the inlet temperature of the compressor 143.

A flow amount of a refrigerant to be introduced into each of the first and second evaporators 141*a*, 141*b* may be determined based on a super heat degree of the refrigerant having passed through each of the first and second evaporators 141*a*, 141*b*. For example, as a drying process of the clothes dryer is executed, a super heat degree of a refrigerant passing through each of the first and second evaporators 141*a*, 141*b* may be increased. The measured super heat degree of the refrigerant may be compared with a reference super heat degree. If the measured super heat degree of the refrigerant is higher than the reference super heat degree, a flow amount of the refrigerant to be introduced into each of the first and second evaporators 141*a*, 141*b* may be increased.

A method for controlling a condensing first and second type clothes dryer having a heat pump cycle according to an embodiment may include sensing a super heat degree of a refrigerant (operation fluid) passing through each of a plurality of evaporators, such as first and second evaporators 141*a*, 141*b* of FIG. 3; diverging the operation fluid discharged from a condenser, such as condenser 142 of FIG. 3, to a plurality of divergence passages; and controlling a flow amount of the refrigerant to be introduced into each of the plurality of evaporators based on the sensed super heat degree of the operation fluid.

The plurality of evaporators may include first evaporator 141*a* and second evaporator 141*b* provided in a circulation duct, such as circulation duct 120 of FIG. 3, in a vertical direction, that is, in a direction substantially perpendicular to a direction of air flow in the circulation duct 120 and a same amount of refrigerant may be introduced into each of the first evaporator 141*a* and the second evaporator 141*b*.

A plurality of electronic expansion valves, such as electronic expansion valves 144*a*, 144*b* of FIG. 3, may be installed at or in divergence pipes, such as divergence pipes 146*a*, 146*b* of FIG. 3, which form divergence passages, such that a refrigerant discharged from the condenser 142 may be introduced into each of the first and second evaporators 141*a*, 141*b* in a diverged manner. Then, a flow amount of the refrigerant to be introduced into each of the first and second evaporators 141*a*, 141*b* may be determined based on a super heat degree of the refrigerant passing through each of the first and second evaporators 141*a*, 141*b*. Further, an unbalanced flow amount of the refrigerant may be prevented based on a state of humid air introduced into each of the first and second evaporators 141*a*, 141*b*, that is, an evaporation load. Even in a case in which the first and second evaporators 141*a*, 141*b* have different sizes from each other, a flow amount of a refrigerant to be introduced into each of the first and second evaporators 141*a*, 141*b* may be properly controlled.

Figure 5:
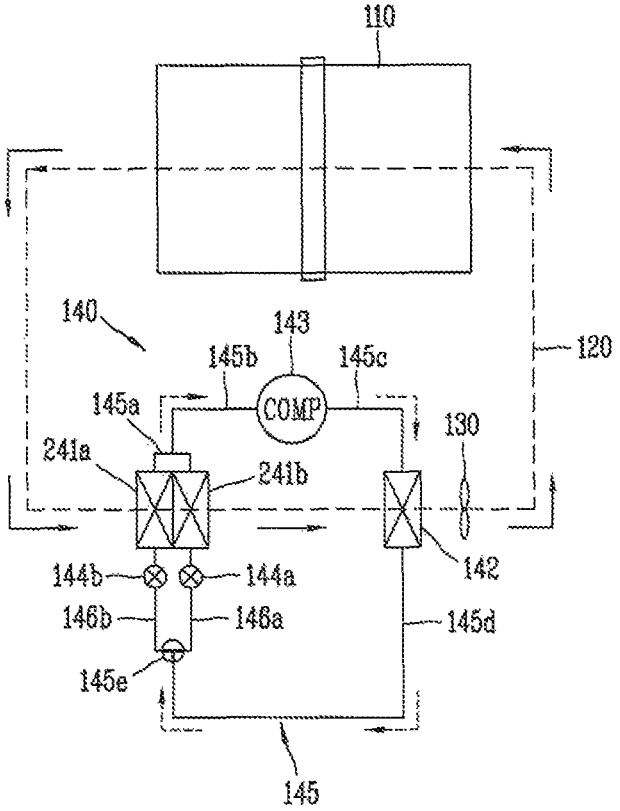
FIG. 5 is a schematic view of a condensing type clothes dryer having a heat pump cycle according to another embodiment.
Figure 6:
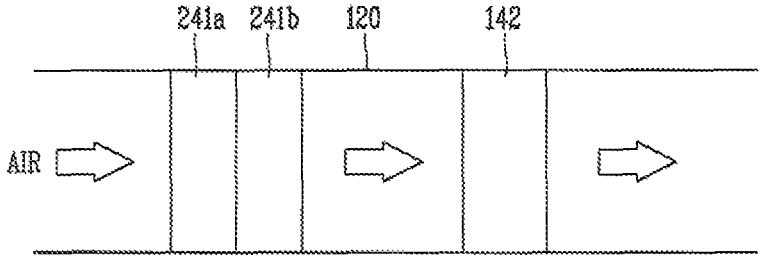
FIG. 6 is a schematic view illustrating a flow of air that passes through an evaporator and a condenser in a circulation duct according to another embodiment.

FIG. 5 is a schematic view of a condensing type clothes dryer having a heat pump cycle according to another embodiment. FIG. 6 is a schematic view illustrating a flow of air that passes through an evaporator and a condenser in a circulation duct according to another embodiment.

A plurality of evaporators 241*a*, 241*b*, as shown in FIGS. 5 and 6, may include a first evaporator 241*a* and a second evaporator 241*b* provided in the circulation duct 120 in a line close to each other or sequentially, that is, in a direction of air flow in the circulation duct 120. For example, based on a moving direction of air discharged from the drum 110, the first evaporator 241*a* and the second evaporator 241*b* may be arranged close together at an upstream side and a downstream side, respectively. Configurations according to this embodiment may be the same as or similar to those of the previous embodiment, and thus, repetitive has been omitted.

As the first and second evaporators 241*a*, 241*b* are partitioned from each other based on an air moving direction, a pipe length of each of the first and second evaporators 141*a*, 141*b* may be reduced by ½. As a result, pressure loss may be reduced.

In a case in which the first and second evaporators 241*a*, 241*b* are partitioned from each other, a state of humid air introduced into each of the first and second evaporators 241*a*, 241*b*, that is, an evaporation load, may be different. If a larger amount of refrigerant is introduced into the second evaporator 241*b* provided at the downstream side, a liquid refrigerant may be sucked into the compressor 143.

In order to prevent such an unbalanced state of a refrigerant, the plurality of electronic expansion valves 144*a*, 144*b* may be provided at the divergence pipes 146*a*, 146*b*, which form the divergence passages, such that a refrigerant discharged from the condenser 142 may be introduced into each of the first and second evaporators 241*a*, 241*b*. Then, a super heat degree of the refrigerant introduced into each of the first and second evaporators 241*a*, 241*b* may be measured, thereby determining a flow amount of the refrigerant to be introduced into each of the first and second evaporators 241*a*, 241*b*.

For example, where the first and second evaporators 241*a*, 241*b* are partitioned from each other in the circulation duct 120, the first evaporator 241*a* provided at a front or upstream side may absorb a larger amount of heat from air having passed through the drum 110, than the second evaporator 241*b* provided at a rear or downstream side. Thus, a super heat degree of the refrigerant passing through the first evaporator 241*a* may be higher than a super heat degree of the refrigerant passing through the second evaporator 241*b*. As a result, a flow amount of the refrigerant to be introduced into the first evaporator 241*a* may be increased more than a flow amount of the refrigerant to be introduced into the second evaporator 241*b*. In this case, an open degree of the divergence passage may be increased such that a larger amount of refrigerant may be introduced into the first evaporator 241*a* than the second evaporator 241*b*.

Embodiments disclosed herein provide a condensing type clothes dryer having a heat pump cycle, capable of enhancing performance by reducing pressure loss in an evaporator, and a method for controlling a condensing type clothes dryer having a heat pump cycle.

Embodiments disclosed herein further provide a condensing type clothes dryer having a heat pump cycle, capable of controlling a flow amount of an operation fluid introduced into a plurality of evaporators, based on a super heat degree of the operation fluid (refrigerant) having passed through the plurality of evaporators, and a method for controlling a condensing type clothes dryer having a heat pump cycle.

Embodiments disclosed herein provide a condensing type clothes dryer having a heat pump cycle that may include a drum where an object to be dried may be accommodated; a circulation duct, which may form a circulation passage such that air may circulate via the drum; and a heat pump cycle having a plurality of evaporators disposed or provided close to or adjacent to each other in the circulation duct, having a condenser disposed or provided at a downstream side of the evaporators in a spaced manner, and configured to absorb heat of air discharged from the drum through the evaporators, and to transfer the heat to air introduced into the drum through the condenser, using an operation fluid which circulates via the evaporators and the condenser. The heat pump cycle may include a plurality of divergence pipes, which may form a divergence passage, such that the operation fluid discharged from the condenser may be introduced into each of the plurality of evaporators; a plurality of electronic expansion valves installed at the divergence pipes, and configured to open and close the divergence passage; and a control unit or controller configured to control a flow amount of the operation fluid introduced into each of the evaporators by controlling an open degree of the divergence passage based on a super heat degree of the operation fluid passing through each of the evaporators.

The evaporators may include a first evaporator and a second evaporator disposed or provided in the circulation duct up and down or in a vertical direction. The evaporators may include a first evaporator and a second evaporator disposed or provided in the circulation duct in a line or sequentially. The electronic expansion valves may include a first electronic expansion valve and a second electronic expansion valve installed or provided at the divergence pipes, and configured to control a flow amount of the operation fluid to be introduced into each of the first evaporator and the second evaporator.

The heat pump cycle may include a compressor configured to compress the operation fluid discharged from the evaporators and to transfer the operation fluid to the condenser; a first temperature sensor installed or provided at an inlet of each of the evaporators, and configured to sense a temperature of the operation fluid at the inlet of each of the evaporators; a second temperature sensor installed or provided at an inlet of the compressor, and configured to sense a temperature of the operation fluid at the inlet of the compressor. The control unit may be configured to determine a super heat degree of the operation fluid by comparing a temperature of the operation fluid at the inlet of the compressor with that at the inlet of each of the evaporators, based on detection signals received from the first and second temperature sensors.

Embodiments disclosed herein further provide a method for controlling a condensing type clothes dryer that may include a drum where an object to be dried may be accommodated; a circulation duct, which may form a circulation passage such that air may circulate via the drum; and a heat pump cycle having a plurality of evaporators disposed or provided close to or adjacent to each other in the circulation duct, having a condenser disposed or provided at a downstream side of the evaporators in a spaced manner, and configured to absorb heat of air discharged from the drum through the evaporators, and to transfer the heat to air introduced into the drum through the condenser, using an operation fluid which circulates via the evaporators and the condenser. The method may include sensing a super heat degree of an operation fluid passing through the plurality of evaporators; diverging the operation fluid discharged from the condenser to a plurality of divergence passages; and controlling a flow amount of the operation fluid introduced into each of the plurality of evaporators based on the sensed super heat degree of the operation fluid.

The super heat degree of the operation fluid may be measured based on a difference between a temperature of the operation fluid measured at an inlet of a compressor and a temperature of the operation fluid measured at an inlet of each of the evaporators. A flow amount of the operation fluid introduced into each of the evaporators may be increased as an open degree of the divergence passage is controlled according to an increase of the super heat degree of the operation fluid.

The evaporators may include a first evaporator and a second evaporator disposed or provided in the circulation duct up and down or in a vertical direction, and a same amount of operation fluid may be introduced into each of the first evaporator and the second evaporator. The evaporators may include a first evaporator and a second evaporator disposed in the circulation duct in a line or sequentially. The operation fluid may be introduced into each of the first evaporator and the second evaporator with a different flow amount determined based on a super heat degree of the refrigerant having passed through each of the evaporators.

When a super heat degree of the operation fluid introduced into the first evaporator is larger than a super heat degree of the operation fluid introduced into the second evaporator, a flow amount of the operation fluid introduced into the first evaporator may be increased more than a flow amount of the operation fluid introduced into the second evaporator. The flow amount of the operation fluid introduced into each of the plurality of evaporators may be controlled by electronic expansion valves installed at the plurality of divergence passages.

As the evaporator is divided into two evaporators, such that a length of a refrigerant pipe of each evaporator is reduced in half, pressure loss in the evaporator may be reduced. This can prevent unnecessary power consumption of the compressor, and enhance performance.

Further, the electronic expansion valves may be installed or provided at the plurality of divergence passages along which a refrigerant may be introduced into each of the plurality of evaporators, and a super heat degree of each evaporator may be determined to control a flow amount of a refrigerant introduced into each evaporator. Accordingly, an unbalanced flow amount of a refrigerant may be prevented based on an evaporation load of wet air introduced into each evaporator.

Furthermore, even if the plurality of evaporators are designed to have different sizes, a flow amount of a refrigerant may be properly controlled according to the size of each evaporator.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A condensing type clothes dryer having a heat pump cycle, comprising: a drum in which an object to be dried is accommodated;

a circulation duct that forms a circulation passage that circulates air through the drum; and a heat pump cycle-including:

a plurality of evaporators provided adjacent to each other in the circulation duct, that absorb heat of air discharged from the drum through the plurality of evaporators, using an operation fluid that circulates via the plurality of evaporators;

a condenser provided at a downstream side of the plurality of evaporators and spaced from the plurality of evaporators, that transfers heat to air introduced into the drum through the condenser, using an operation fluid that circulates via: the condenser;

a plurality of divergence pipes that form a divergence passage such that the operation fluid discharged from the condenser is introduced into each of the plurality of evaporators;

a plurality of electronic expansion valves provided at the plurality of divergence pipes, that opens and closes the divergence passage; and a controller that controls a flow amount of the operation fluid introduced Into each of the plurality of evaporators by controlling an open degree of the divergence passage based on a super heat degree of the operation fluid passing through each of the plurality of evaporators.

2. The condensing type clothes dryer of claim 1, wherein the plurality of evaporators includes a first evaporator and a second evaporator provided in the circulation duct In a direction substantially perpendicular to a direction of air flow in the circulation duct.

3. The condensing type clothes dryer of claim 2, wherein the first evaporator and the second evaporator are provided in the circulation duct without a gap therebetween.

4. The condensing type clothes dryer of claim 2, wherein the first evaporator is provided adjacent to an upper portion of the circulation duct and the second evaporator is provided adjacent to a lower portion of the circulation duct.

5. The condensing type clothes dryer of claim 1, wherein the plurality of evaporators includes a first evaporator and a second evaporator provided In the circulation duct in a line with respect to a direction of airflow in the circulation duct.

6. The condensing type clothes dryer of claim 5, wherein the first evaporator and the second evaporator are provided in the circulation duct without a gap therebetween.

7. The condensing type clothes dryer of claim 1, wherein the plurality of electronic expansion valves Includes a first electronic expansion valve and a second electronic expansion valve provided at the plurality of divergence pipes, respectively, that control a flow amount of the operation fluid introduced into each of a first evaporator and a second evaporator.

8. The condensing type clothes dryer of claim 1, wherein the heat pump cycle further includes:

a compressor that compresses the operation fluid discharged from the plurality of evaporators and transfers the operation fluid to the condenser;

a first temperature sensor provided at an inlet of each of the plurality of evaporators, that senses a temperature of the operation fluid at the inlet of each of the plurality of evaporators;

a second temperature sensor provided at an inlet of the compressor, that senses a temperature of the operation fluid at the inlet of the compressor, and wherein the controller determines the super heat degree of the operation fluid by comparing the temperature of the operation fluid at the inlet of the compressor with the temperature at the inlet of each of the plurality of evaporators, based on detection signals received from the first and second temperature sensors.

9. The condensing type clothes dryer of claim 1, wherein the condenser Includes a fin and tube-type heat exchanger.

10. A method for controlling a condensing type clothes dryer including a drum in which an object to be dried is accommodated, a circulation duct that forms a circulation passage such that air circulates via the drum, and a heat pump cycle having a plurality of evaporators provided adjacent to each other in the circulation duct, a condenser provided at a downstream side of the plurality of evaporators and spaced therefrom, that absorbs heat of air discharged from the drum through the plurality of evaporators and transfers the heat to air introduced into the drum through the condenser, using an operation fluid that circulates via the plurality of evaporators and the condenser, the method comprising;

sensing a super heat degree of the operation fluid passing through the plurality of evaporators; and diverging the operation fluid discharged, from the condenser to a plurality of divergence passages, and controlling a flow amount of the operation fluid to be introduced Into each of the plurality of evaporators based on sensed super heat degree of the operation fluid.

11. The method of claim 10, wherein sensing a super heat degree of the operation fluid passing through the plurality of evaporators includes measuring the super heat degree of the operation fluid passing through the plurality of evaporators based on a difference between a temperature of the operation fluid measured at an inlet of a compressor and a temperature of the operation fluid measured at an inlet of each of the plurality of evaporators, and wherein controlling a flow amount of the operation fluid to be introduced into each of the plurality of evaporators based on the sensed super heat degree of the operation fluid Includes increasing a flow amount of the operation fluid introduced into each of the plurality of evaporators as an open degree of the divergence passage is controlled according to an increase in the super heat degree of the operation fluid.

12. The method of claim 10 wherein the evaporator includes a first evaporator and a second evaporator provided in the circulation duct in a direction substantially perpendicular to a direction of air flow In the circulation duct, and wherein a same amount of operation fluid is Introduced into each of the first evaporator and the second evaporator.

13. The method of claim 10, wherein the plurality of evaporators include a first evaporator and a second evaporator provided in the circulation duct in a line with respect to a direction of air flow in the circulation duct, and wherein the operation fluid is introduced into each of the first evaporator and the second evaporator with a different flow amount determined based on a super heat degree of the refrigerant having passed through each of the plurality of evaporators.

14. The method of claim 13, wherein when a super heat degree of the operation fluid introduced Into the first evaporator is larger than a super heat degree of the operation fluid introduced into the second evaporator, the controlling a flow amount of the operation fluid to be introduced into each of the plurality of evaporators based on the sensed super heat degree of the operation fluid includes increasing a flow amount of the operation fluid to be Introduced into the first evaporator more than a flow amount of the operation fluid to be introduced into the second evaporator.

15. The method of claim 10, wherein the controlling a flow amount of the operation fluid to be introduced into each of the plurality of evaporators based on sensed super heat degree of the operation fluid includes controlling the flow amount of the operation fluid introduced into each of the plurality of evaporators by a plurality of electronic expansion valves provided at the plurality of divergence passages, respectively.

16. A condensing type clothes dryer having a heat pump cycle, comprising;

a drum in which an object to be dried is accommodated;

a circulation duct that forms a circulation passage such that air circulates via the drum; and a heat pump cycle including:

a plurality of evaporators provided adjacent to each other in the circulation duct, that absorb heat of air discharged from the drum, using an operation fluid that circulates via the plurality of evaporators;

a condenser provided at a downstream side of the plurality of evaporators and spaced from the plurality of evaporators, that transfers the heat to air Introduced into the drum through the condenser, using an operation fluid that circulates, via the condenser;

a compressor that compresses the operation fluid discharged from the plurality of evaporators and transfers the operation fluid to the condenser;

a plurality of divergence pipes that form a divergence passage such that the operation fluid discharged from the condenser is introduced into each of the plurality of evaporators;

a plurality of electronic expansion valves provided at the plurality of divergence pipes, that opens and closes the divergence passage; and a controller that controls a flow amount of the operation fluid introduced into each of the plurality of evaporators by controlling an open degree of the divergence passage based on a super heat degree of the operation fluid passing through each of the plurality of evaporators, wherein the super heat degree of the operation fluid passing through each of the plurality of evaporators is determined based on a temperature of the operation fluid at an inlet of each of the plurality of evaporators and a temperature of the operation fluid at an inlet of the compressor.

17. The condensing type clothes dryer of claim 16, wherein the plurality of evaporators includes a first evaporator and a second evaporator provided in the circulation duct in a direction substantially perpendicular to a direction of air flow In the circulation duct.

18. The condensing type clothes dryer of claim 16, wherein the plurality of evaporators includes a first evaporator and a second evaporator provided in the circulation duct in a line with respect to a direction of air flow in the circulation duct.

19. The condensing type clothes dryer of claim 16, wherein the plurality of electronic expansion valves includes a first electronic expansion valve and a second electronic expansion valve provided at the plurality of divergence pipes, respectively, that control a flow amount of the operation fluid introduced into each of the first evaporator and the second evaporator.

20. The condensing type clothes dryer of claim 16, wherein the heat pump cycle further includes:

a first temperature sensor provided at the inlet of each of the plurality of evaporators, that senses the temperature of the operation fluid at the inlet of each of the plurality of evaporators; and a second temperature sensor provided at the inlet of the compressor, that senses the temperature of the operation fluid at the inlet of the compressor, and wherein the controller determines the super heat degree of the operation fluid by comparing the temperature of the operation fluid at the inlet of the compressor with the temperature at the Inlet of each of the plurality of evaporators, based on detection signals received from the first and second temperature sensors.

* * * * *